US009412553B2

(12) United States Patent
Camara

(10) Patent No.: US 9,412,553 B2
(45) Date of Patent: Aug. 9, 2016

(54) TRANSMISSION X-RAY GENERATOR

(71) Applicant: Carlos G. Camara, Marina Del Rey, CA (US)

(72) Inventor: Carlos G. Camara, Marina Del Rey, CA (US)

(73) Assignee: Tribogenics, Inc., Los Angeles, CA (US)

( * ) Notice: Subject to any disclaimer, the term of this patent is extended or adjusted under 35 U.S.C. 154(b) by 253 days.

(21) Appl. No.: 13/839,535

(22) Filed: Mar. 15, 2013

(65) Prior Publication Data

US 2014/0270084 A1 Sep. 18, 2014

(51) Int. Cl.
*H01J 35/02* (2006.01)
*H01J 35/06* (2006.01)

(52) U.S. Cl.
CPC ..... *H01J 35/06* (2013.01); *H01J 2235/066* (2013.01); *H01J 2235/087* (2013.01)

(58) Field of Classification Search
CPC ..... H01J 2235/066; H01J 2235/087; H01J 35/06
USPC ..... 378/121–141
See application file for complete search history.

(56) References Cited

U.S. PATENT DOCUMENTS

| | | | | |
|---|---|---|---|---|
| 2,810,077 | A | 10/1957 | Gale | |
| 3,612,918 | A | 10/1971 | Willutzki | |
| 4,789,802 | A | 12/1988 | Miyake | |
| 4,990,813 | A | 2/1991 | Paramo | |
| 5,665,969 | A | 9/1997 | Beusch | |
| 6,476,406 | B1 | 11/2002 | Struye et al. | |
| 6,493,423 | B1 | 12/2002 | Bisschops | |
| 6,559,451 | B1 * | 5/2003 | Izumi | H01L 27/12 250/370.01 |
| 6,668,039 | B2 | 12/2003 | Shepard et al. | |
| 6,925,151 | B2 | 8/2005 | Harding et al. | |
| 7,060,371 | B2 | 6/2006 | Akiyama et al. | |
| 7,596,242 | B2 | 9/2009 | Breed et al. | |
| 2009/0050847 | A1 | 2/2009 | Xu et al. | |
| 2011/0002442 | A1 * | 1/2011 | Thran | H01J 35/065 378/22 |
| 2011/0130613 | A1 | 6/2011 | Putterman et al. | |

FOREIGN PATENT DOCUMENTS

SU 1149331 A1 * 4/1985

OTHER PUBLICATIONS

Stefan Kneip, A stroke of X-ray, May 26, 2011, Nature, vol. 473, 455-456.*
Hird et al., A triboelectric x-ray source, Mar. 28, 2011, Applied Physics Letters 98, 133501-1-3.*

(Continued)

*Primary Examiner* — David J Makiya
*Assistant Examiner* — Dani Fox
(74) *Attorney, Agent, or Firm* — Klein, O'Neill & Singh, LLP

(57) ABSTRACT

An x-ray transmission device includes two surfaces in frictional contact within a low fluid pressure environment provided by a housing substantially opaque to x-rays. Materials of the two surfaces are selected such that the frictional contact generates relative charging between the surfaces. The housing includes a window substantially transparent to x-rays, and an electron target, for example a metal, is on an interior surface of the window. The electron target faces the surface that is relatively negatively charged, such that electrons accelerated from that surface, or accelerated due to the negative charge of that surface strike the electron target to generate x-rays, which may be transmitted through the window.

11 Claims, 3 Drawing Sheets

(56) References Cited

OTHER PUBLICATIONS

Klyuev et al., "The effect of air pressure on the parameters of x-ray emission accompanying adhesive and cohesive breaking solids", Sov. Phys. Tech. Phys., vol. 34, Mar. 1989, pp. 361-364.
Nakayama et al., "Triboemission of charged particles and photons from solid surfaces during frictional damage", Journal of Physics D. Applied Physics, vol. 25, No. 2, Feb. 14, 1992, pp. 303-308.
Nishitani et al., "STM tip-enhanced photoluminescence from porphyrin film", Surface Science, North-Holland Publishing Co., vol. 601, No. 17, Aug. 23, 2007, pp. 3601-3604.
Ohara et al., "Light emission due to peeling of polymer films from various substrates", Journal of Applied Polymer Science, vol. 14, No. 8, Aug. 1, 1970, pp. 2079-2095.

* cited by examiner

TRANSMISSION X-RAY GENERATOR

BACKGROUND OF THE INVENTION

The present invention relates generally to generation of x-rays, and more particularly to a tribocharging x-ray transmitter.

X-rays are used in a variety of ways. X-rays may be used for medical or other imaging applications, crystallography related applications including material analysis, or in other applications.

X-rays are generally generated by electron braking (bremmstrahlung) or inner shell electron emission within a material. Historically, other than through natural phenomena, x-rays generally have been generated by accelerating electrons into a material, such as a metal, with a small proportion of the electrons causing x-rays through bremmstrahlung or knocking electrons present in the material out of inner orbitals, for example K-shell orbitals, with x-rays being generated as electrons in higher energy orbitals transition to the lower energy orbitals. Acceleration of the electrons to generate a useful quantity of x-rays, however, generally requires high powered electrical energy sources, which may include bulky equipment.

X-rays may also be generated by changes in mechanical contact between materials in a controlled environment, for example through the unpeeling of pressure sensitive adhesive tape or mechanical contact of some materials in an evacuated chamber. However, x-rays within the controlled environment may not be particularly useful.

BRIEF SUMMARY OF THE INVENTION

An aspect of the invention provides an x-ray transmitter device, comprising: a housing for maintaining a low fluid pressure environment, the housing including a window substantially transparent to x-rays, with a metal on an interior surface of the window; and two surfaces arranged within the housing for time varying contact with one another, a first of the surfaces have at least a portion not obstructed from the window by a second of the surfaces, materials of the two surfaces selected such that time varying contact between the surfaces results in a charge imbalance between the surfaces.

These and other aspects of the invention are more fully comprehended upon review of this disclosure.

DETAILED DESCRIPTION

Figure 1:
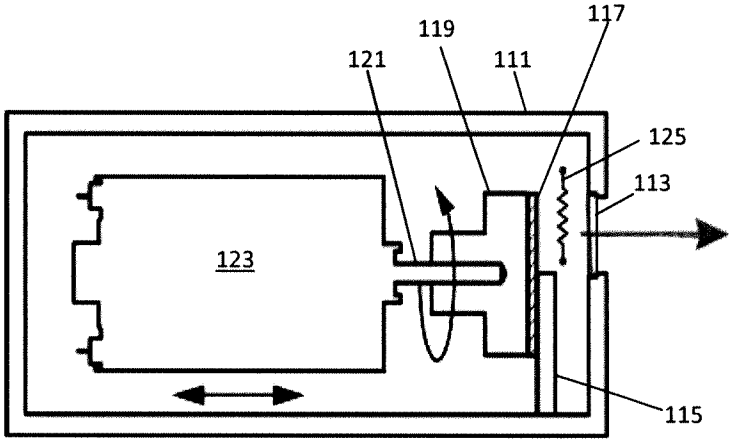
FIG. 1 is a partial cut-away view of an x-ray transmission device in accordance with aspects of the invention.

FIG. 1 is a partial cut-away view of an x-ray transmission device in accordance with aspects of the invention. The transmission device includes a housing 111 enclosing a chamber. The housing includes a window 113 substantially transparent to x-rays. The window may be, for example, a Beryllium window. The housing is configured so as to be able to maintain a controlled fluid pressure in the chamber, for example through the assistance of a vacuum pump (not shown) coupled to a port (not shown) in the housing. The desired fluid pressure is generally less than 100 mTorr, or, in various embodiments, less than 100 mTorr, 50 mTorr, 1 mTorr, or 0.001 mTorr. In some embodiments a gas, such as Argon, is contained in the housing, with the gas serving to assist in control of current flow from oppositely charged surfaces or from a charged surface to ground, and the gas can serve as a source of electrons. Partial pressure of the gas may be, for example, 50 mTorr, and in some embodiments may be between 1 mTorr and 50 mTorr.

A rotor 119 is within the chamber. The rotor includes a face 117, which may be a membrane covering. The face is positioned to be in moveable contact with a rod 115, which may be for example mounted to a wall of the housing, preferably in an electrically grounded fashion. In various embodiments the rod may be replaced by other structures, for example a sheet, with or without apertures therethough. The rotor may be of a glass, for example a quartz glass, to provide a backing and electrical insulation for material of the face. The face may be an electrical insulator, in some embodiments a polyimide film, for example Kapton. The rod may be a metal rod, for example a molybdenum rod. In various embodiments, material of the rod and the face are chosen such that the face becomes negatively charged due through tribocharging effects when there is varying surface contact between the face and the rod.

A surface of the face of the rotor faces the window of the housing, with the rod positioned between the face and the wall including the window. A portion of the face, at any given time, has a line of sight to the window not obstructed by the rod. For example, as illustrated in the embodiment of FIG. 1, the rod extends over what may be considered a lower portion of the face, with an upper portion of the face being clear of the rod and in line with the window.

The rotor is coupled to an axle 121, driven by a motor 123. In the embodiment of FIG. 1, the motor and axle are shown within the chamber defined by the housing. In various embodiments, however, portions of the motor and/or axle, including all of the motor and portions of the axle, may be outside the chamber, with other portions extending through a wall of the housing. In some embodiments, the rotor is magnetically coupled to a motor driver external to the housing.

Rotation of the axle by the motor results in rotation of the rotor, which in turn results in moving time-varying contact between varying areas of the surface of the face and the rod. As indicated above, this contact results in relative electrical charging between the face and the rod, with the face becoming negatively charged. The charge imbalance between the rod and the face sets an electric field with a potential proportional to the magnitude of the surface charge density, which accelerates electrons away from the face. Some of these electrons will accelerate towards the window, which is in the line of sight of a portion of the face.

An interior surface of the window is coated with a metal, for example gold, which serves as an electron target for the electrons. The electrons accelerating towards the window will strike the gold, with some of the strikes resulting in emission of x-rays. Some of these x-rays will pass through the window, which is substantially transparent to x-rays, and the device may therefore serve as an x-ray transmission source. As the electron target is on a surface of the window, x-rays are generated in close proximity to the window, generally resulting in increased efficiency of x-ray transmission through the window.

In some embodiments, and as illustrated in FIG. 1, an electron source, for example a metallic filament 125 is provided in the housing near the exposed portion of the face of the rotor. Provision of current to the filament provides an additional source of electrons, potentially increasing quantity of electrons which may be used to generate x-rays.

In some embodiments the motor, axle, rotor, and rod are moveable within the housing so as to allow for variation in distance between the exposed portion of the face and the window. Such adjustability may provide for increased control of x-ray flux through the window. In some embodiments the motor, axle, and rotor are moveable within the housing with respect to position of the rod, with in some embodiments these elements to periodically place the face in contact with the rod during operation, and periodically withdraw the face from contact with the rod. In such instances, electrons may be discharged from the face in greater quantities as the face loses contact with the rod, also allowing for increased control of x-ray emission from the device.

Figure 2:
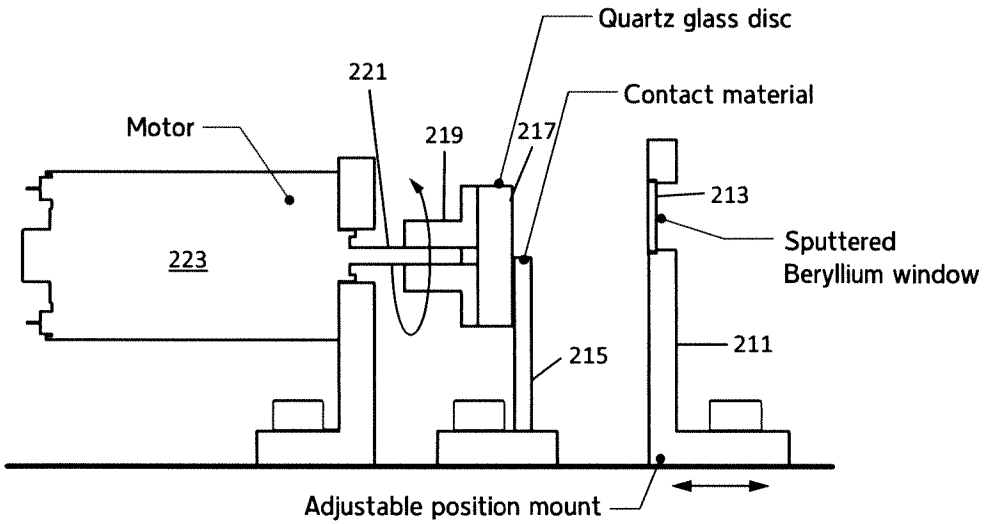
FIG. 2 is a view of portions of another embodiment of portions of an x-ray transmission device in accordance with aspects of the invention.

FIG. 2 is a view of portions of another embodiment of portions of an x-ray transmission device in accordance with aspects of the invention. The x-ray transmission device enclosed in a housing, with a portion of the sidewalls 211 shown in FIG. 2. The housing is configured to maintain a controlled fluid pressure environment, and the housing is generally opaque to x-rays. The portion of the sidewalls shown includes a window 213. The window itself is substantially transparent to x-rays, but metal coating on an interior side, with for example the metal coating being gold sputtered on to the interior surface of the window.

A contact material, for example a rod 215, is within the housing. The rod is for example comprised of a metal, and is preferably electrically grounded. A face 217 of a rotor is in contact with the rod. The face of the rotor is for example a polyimide membrane, and is for example backed by a quartz glass disc. The disc may be mounted to a base 219, to which an axle 221 is coupled. The axle in turn is coupled to a motor 223, for example through a feed through in a wall of the housing.

Operation of the motor rotates the rotor, resulting in time varying contact between surfaces of the face of the rotor and the rod. This time varying contact between the two materials causes negative charge accumulation on the face of the rotor, with electrons accelerating away from the face and towards the sputtered metal on the interior of the window. The electrons striking the sputtered metal, or at least some of the electrons, generate x-rays, at least some of which pass through the window.

In the embodiment of FIG. 2, the wall of the housing including the window is translatable with respect to the rod. For example, the wall may effectively serve as an adjustable mount, with the adjustable mount moveable within a cavity of one end of the housing. Movement of the adjustable mount allows the window to be placed relatively closer or farther from the rod and face of the rotor, allowing for increased or decreased quantities of electrons striking the sputtered metal on the window, and consequently increased or decreased levels of x-rays transmitted through the window.

Figure 3:
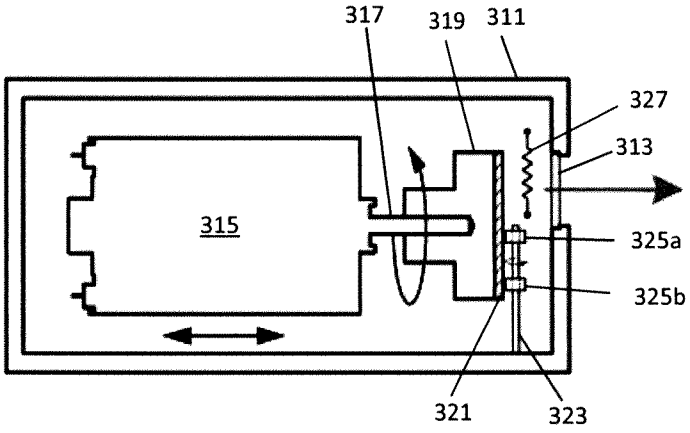
FIG. 3 illustrates a partial cutaway view of an x-ray transmission device in accordance with aspects of the invention.

FIG. 3 illustrates a partial cutaway view of an x-ray transmission device in accordance with aspects of the invention. The device of FIG. 3 is similar to the device of FIG. 1. In the device of FIG. 3, however, the face of the rotor contacts rollers 325*a,b* instead of a rod.

As shown in FIG. 3, the device includes a housing 311, with the housing preferably substantially opaque to x-rays. The housing is configured to maintain a low fluid pressure environment in a chamber enclosed by the housing. A window 313 is located on a wall of the housing. The window itself is substantially transparent to x-rays, although a metal is on an interior surface of the window.

A rotor 319 within the housing has a face in contact with the rollers 325*a,b*. An axle 317 couples the rotor and a motor 315. The motor drives the axle to rotate the rotor, causing the face of the rotor to rotate and to rotate the rollers. The rotation of the face results in time varying contact between different surface areas of the face and different surface areas of the rollers. Material of the face of the roller and material of surfaces of the roller bearings are selected such that the varying surface contact between the face and the rollers results in relative electrical charging between the face and the rollers, with the face becoming negatively charged. The charge imbalance, as previously mentioned results in acceleration of electrons away from the face, with some of the electrons striking the metal on the interior of the window, and some of those strikes resulting in generation of x-rays which are transmitted through the window.

In some embodiments the rollers includes a surface with a first portion of a first dielectric material and a second portion of a second different dielectric material with a lower dielectric constant. Each of the first dielectric material and the second dielectric material are exposed on the surface of the roller in different areas. As the roller rolls across the face, the first portion and the second portion alternate in contacting the face. This alternating contact results in variation of compensating charge, with accumulated negative charge on the face being ejected as the second dielectric material contacts the face, providing it is believed for increased generation of x-rays.

Although the invention has been discussed with respect to various embodiments, it should be recognized that the invention comprises the novel and non-obvious claims supported by this disclosure.

What is claimed is:

1. An x-ray transmitter device, comprising:

a housing for maintaining a low fluid pressure environment, the housing including a window substantially transparent to x-rays, with a metal on an interior surface of the window;

a rotor and a rod arranged within the housing for time varying contact between a substantially flat surface of a face of the rotor and a surface of the rod, at least a portion of the face of the rotor not being obstructed from the window by the rod, materials of the face of the rotor and the rod selected such that time varying contact between the surfaces of the face of the rotor and the rod results in relative charging of the surfaces; and a metal filament proximate the face of the rotor and between the face of the rotor and the window of the housing;

wherein the surface on the face of the rotor is a membrane.

2. The device of claim 1, wherein the membrane is on a glass disc of the rotor.

3. The device of claim 1, wherein the rotor is coupled to an axle.

4. The device of claim 3, wherein the axle is coupled to a motor.

5. The device of claim 4, wherein the axle extends through a feed through port in the housing.

6. The device of claim 1, wherein the surface on the face of the rotor is a polyimide film.

7. The device of claim 1, wherein the metal is sputtered on the interior surface of the window.

8. The device of claim 1, wherein the housing, excluding the window, is substantially opaque to x-rays.

9. The device of claim 1, wherein the housing includes a port for evacuation of Gasses from the chamber.

10. The device of claim 1, wherein the window is translatable with respect to the rod and the face of the rotor.

11. The device of claim 1, wherein the rod and the face of the rotor are translatable with respect to the window.

* * * * *